US008622262B2

(12) United States Patent
Van Art

(10) Patent No.: US 8,622,262 B2
(45) Date of Patent: Jan. 7, 2014

(54) HYDRATION SYSTEM

(76) Inventor: Roger L. Van Art, Colorado Springs, CO (US)

( * ) Notice: Subject to any disclaimer, the term of this patent is extended or adjusted under 35 U.S.C. 154(b) by 210 days.

(21) Appl. No.: 13/323,618

(22) Filed: Dec. 12, 2011

(65) Prior Publication Data

US 2012/0152986 A1 Jun. 21, 2012

Related U.S. Application Data

(63) Continuation-in-part of application No. 12/474,459, filed on May 29, 2009, now abandoned.

(60) Provisional application No. 61/135,639, filed on Jul. 22, 2008.

(51) Int. Cl.
*A45F 3/16* (2006.01)

(52) U.S. Cl.
USPC ..... 224/148.2; 224/148.4; 224/222

(58) Field of Classification Search
USPC ..... 224/148.1–148.6, 218–219, 222; 222/175
See application file for complete search history.

(56) References Cited

U.S. PATENT DOCUMENTS

| | | | | |
|---|---|---|---|---|
| 4,139,130 | A * | 2/1979 | Glusker et al. | 224/148.2 |
| 4,988,097 | A * | 1/1991 | Smith et al. | 482/105 |
| 5,607,090 | A | 3/1997 | Brown | |
| 5,755,368 | A * | 5/1998 | Bekkedahl | 224/414 |
| 6,283,344 | B1 | 9/2001 | Bradley | |
| 6,409,048 | B1 | 6/2002 | Belzeski | |
| 8,167,177 | B1 * | 5/2012 | Galgano | 222/175 |
| 8,387,831 | B2 * | 3/2013 | McInerney | 222/175 |
| 2001/0020628 | A1 * | 9/2001 | Campion | 222/103 |
| 2004/0065703 | A1 * | 4/2004 | Bellucci | 224/148.5 |
| 2006/0207902 | A1 * | 9/2006 | Frye et al. | 206/373 |
| 2007/0075094 | A1 | 4/2007 | Brown | |

* cited by examiner

*Primary Examiner* — Adam Waggenspack
(74) *Attorney, Agent, or Firm* — Robert L. Shaver; Dykas & Shaver

(57) ABSTRACT

The invention is a hydration system that is worn on a user's arm. The system has a flexible sleeve that is conical or forms a conical sleeve that fits a person's forearm. A bladder, made of a pliable material, attaches to the sleeve, and has a number of expandable ribs. The bladder is for holding water or liquid for drinking. The bladder can be flat and folds with the sleeve to form a gently tapering form. A frame secures the bladder to the sleeve. A cap is detachably connected to an opening of the bladder, and a drinking straw allows a user to withdraw water from the bladder.

19 Claims, 9 Drawing Sheets

HYDRATION SYSTEM

PRIORITY/CROSS-REFERENCE TO RELATED APPLICATIONS

The present invention claims priority of provisional patent application Ser. No. 61/135,639, filed on Jul. 22, 2008, entitled "HydraGluv"; and is a continuation-in-part application of application Ser. No. 12/474,459, filed May 29, 2009, which is pending, and the disclosure of which is incorporated herein by this reference.

BACKGROUND

Athletes involved in strenuous aerobic exercise require 6-8 ounces of fluid every 20 minutes of aerobic activity. The most common systems for maintaining hydration include water bottles, stopping at water stations and backpack hydration systems. Water bottles are awkward to run with, require a grip (hence tightening the athlete's arms/shoulders) and result in more plastic bottles in landfills (when using disposable bottled water). Stopping at water stations interrupts the momentum of a person running or biking. Backpack water hydration systems are not comfortable during hot weather and result in considerable additional apparatus to adjust for the runner or biker.

Thus there exists a need for a hydration system that is simple to use and comfortable.

SUMMARY OF THE DISCLOSURE

A hydration system that overcomes these and other problem is worn on a user's arm. The system has a flexible sleeve, the lining of which may be a soft or a wicking material, integral with a pliable bladder or reservoir. The bladder has a number of water containing expandable ribs that allow the user to regulate the amount of fluid contained in the bladder. The bladder is adhered to the flexible wicking sleeve, and the combined system has a generally cylindrical to tapered cylindrical shape. The sleeve and bladder can be flat pieces which fold together and attach at the edges to form the tapering cylinder. A number of adjustable straps may be attached to the bladder. If present, the elastic straps extend around the bladder and are perpendicular to a longitudinal axis of the bladder, and are adjustable by a hook and loop attachment. A cap is detachably connected to an opening of the bladder, the opening of which serves to put fluid into the bladder. A swivel joint may be attached to the cap and provides a fluid passageway between an interior of the bladder and an exterior of the bladder. A flexible drinking straw may extend from an exterior end of the swivel joint or the cap. Whether a swivel joint is used or not, the drinking straw or tube extends from a hand end of the bladder and withdraws water from the sleeve generally from the elbow end of the bladder. The point at which the user drinks water is at the end of the straw adjacent to the hand end, and water is extracted at a point adjacent to the elbow end.

This system has a flexible bladder that contracts as water is withdrawn, which minimizes air intake by the athlete. The draw tube terminates in the region of the bladder adjacent to the users elbow which allows for the maximum extraction of fluid, and allows the water to be consumed by lifting the hand toward the user's face, which automatically causes the user's elbow to be lower than his hand, and allows for extraction of the last liquid from the sleeve. The draw-down straps reduce the sloshing of liquid while exercising. The external end of the drinking straw is positioned between the user's thumb and forefinger, which minimizes extraneous motion for the athlete while running/biking and drinking simultaneously. The wrap-around bladder cushions the arm in case of a fall. The hydration system just slides over the user's arm, with the user's thumb sliding into the thumb loop and forefinger in the forefinger loop, and the user is ready to exercise. This hydration system is comfortable and easy to use.

The hydration system in one form has a tapering or conical shape which fits over a user's arm. When the flexible sleeve is flattened out, it thus has a generally trapezoidal shape, which when rolled and connected edge to edge forms a tapering shape. It has a bladder with water-containing compartments, with the bladder attached to a flexible sleeve which has a soft surface on the side in contact with the user's arm, and which has an "elbow end" which is worn adjacent to the user's elbow, and a "hand end" which is adjacent the user's hand when worn. A frame may be attached to the flexible sleeve, and has ribs which fit between the water containing compartments. The frame secures and stabilizes the bladder to the base layer.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

The invention relates to a hydration system that is worn on a user's arm. The system has a flexible sleeve made of an elastic materiel. A bladder, made of a pliable material, has a number of expandable ribs with flat regions between the ribs. The bladder is attached or adhered to the flexible sleeve, and the bladder has a generally cylindrical to tapering shape. The outside of the bladder may be cylindrical and the inside tapering to fit the tapering shape of the typical forearm. A number of adjustable straps are attached to the bladder. The plastic straps extend around the bladder and are perpendicular to a longitudinal axis of the bladder. A cap is detachably connected to an opening of the bladder. A swivel joint may be attached to the cap and provides a fluid passageway between an interior of the bladder and an exterior of the bladder. A flexible drinking straw may extend from the swivel joint, through which water may be withdrawn. The flexible drinking straw may be at the hand end of the sleeve, in which case a tube is provided which extends from the hand end of the sleeve to an extraction point at the elbow end of the sleeve. Alternatively, the drinking straw may extend on the outside of the sleeve, from the hand end to the elbow end of the sleeve, with water being extracted from the elbow end in either case.

This system has a flexible bladder that contracts when water is withdrawn via the drinking straw, which mitigates the user's air intake. The draw tube or the drinking straw terminates at the end of the bladder adjacent to the elbow of the sleeve bladder which allows for the extraction of the maximum of fluid. The draw-down straps reduce the sloshing of liquid while exercising. A drinking end of the straw is positioned at the hand end of the sleeve, and can be between the user's thumb and forefinger, which minimizes extraneous motion of the user when drinking from the hydration system. Having the water withdrawn from the elbow end of the sleeve and the drinking end of the straw at the hand end allows for ease in drinking, by raising the forearm to the user mouth, which automatically causes the water in the bladder to move by gravity to the elbow end, where the drinking straw or draw tube can pick it up.

Figure 1:
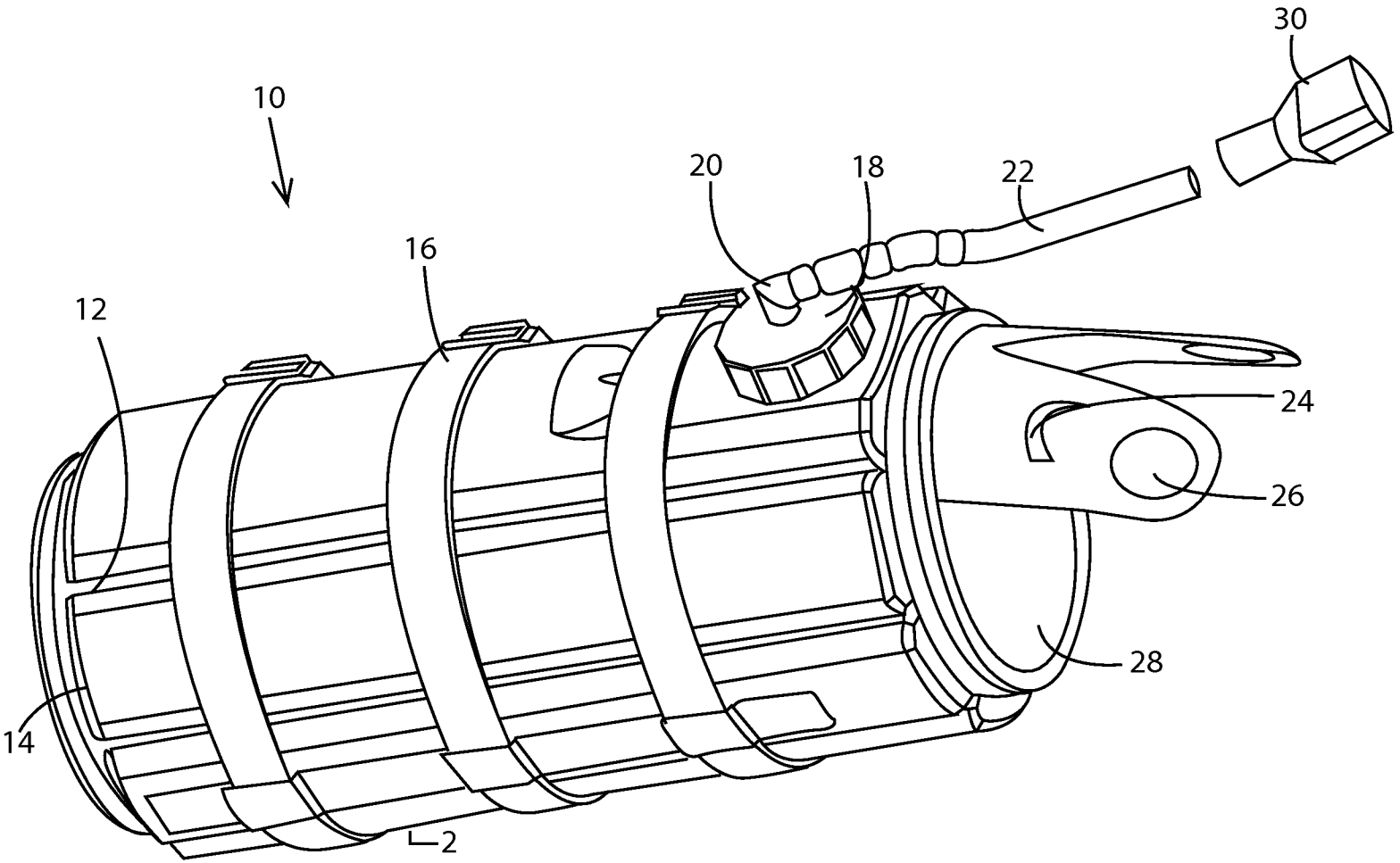
FIG. 1 is a top left perspective view of the hydration system in accordance with one embodiment of the invention.

FIG. 1 is a top left perspective view of the hydration system 10 in accordance with one embodiment of the invention. The hydration system 10 has a bladder 12 made of a pliable material and ranges from a generally cylindrical shape to a tapering or conical shape, to match the tapering shape of a user's arm. In one embodiment, the bladder is made of polyurethane. The bladder 12 has a number of expandable ribs 14. A number of adjustable straps 16 are attached to the bladder 12. In one embodiment, the bladder has one or more constricting bands which reduce the diameter of the bladder 12 as water is withdrawn. The straps 16 run perpendicular to the longitudinal axis of the bladder 12. A cap 18 provides access to the bladder 12. A swivel joint 20 may be attached to the cap 18 and when present provides a fluid passageway between an interior and an exterior of the bladder 12. A flexible drinking straw 22 extends from the exterior end of the cap 18 or swivel joint 20, through a straw loop 24. The straw loop 24 is attached to the thumb loop extensions 26 of a flexible sleeve 28. The flexible sleeve 28 is adhered to the bladder 12. The flexible sleeve 28 is either made of a wicking material or has a liner on the inner diameter of the sleeve 28 that is made of wicking material. At the end of the straw 22 is an optional bite valve 30. Alternatively, a pull valve may be used. A pull valve is opened by pulling on the straw 22 and closed by pushing on the straw 22.

Figure 2:
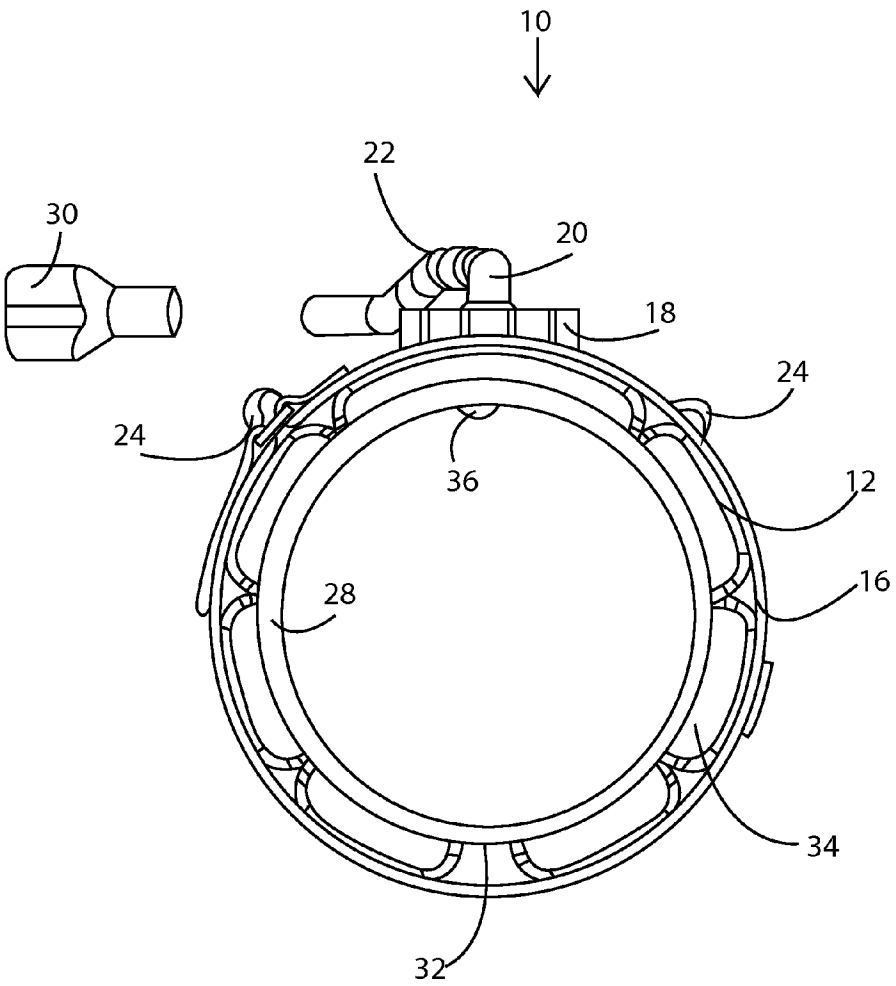
FIG. 2 is a cross sectional view of the hydration system of FIG. 1 along the 2-2 plane in accordance with one embodiment of the invention.

FIG. 2 is a cross sectional view of the hydration system 10 of FIG. 1 along the 2-2 plane in accordance with one embodiment of the invention. This view shows that the side edges of each expandable rib 14 are joined to the sleeve base, such as by being heat sealed, which could be the process by which the strap 16 is attached to the bladder 12. The interior 34 of the bladder shows a tube 36 of the tubing system that connects the interior 34 of the bladder to the exterior of the bladder. The tubing system includes the tube 36, the swivel joint 20 and flexible straw 22. Shown in FIG. 2 is an optional bite valve 30.

Figure 3:
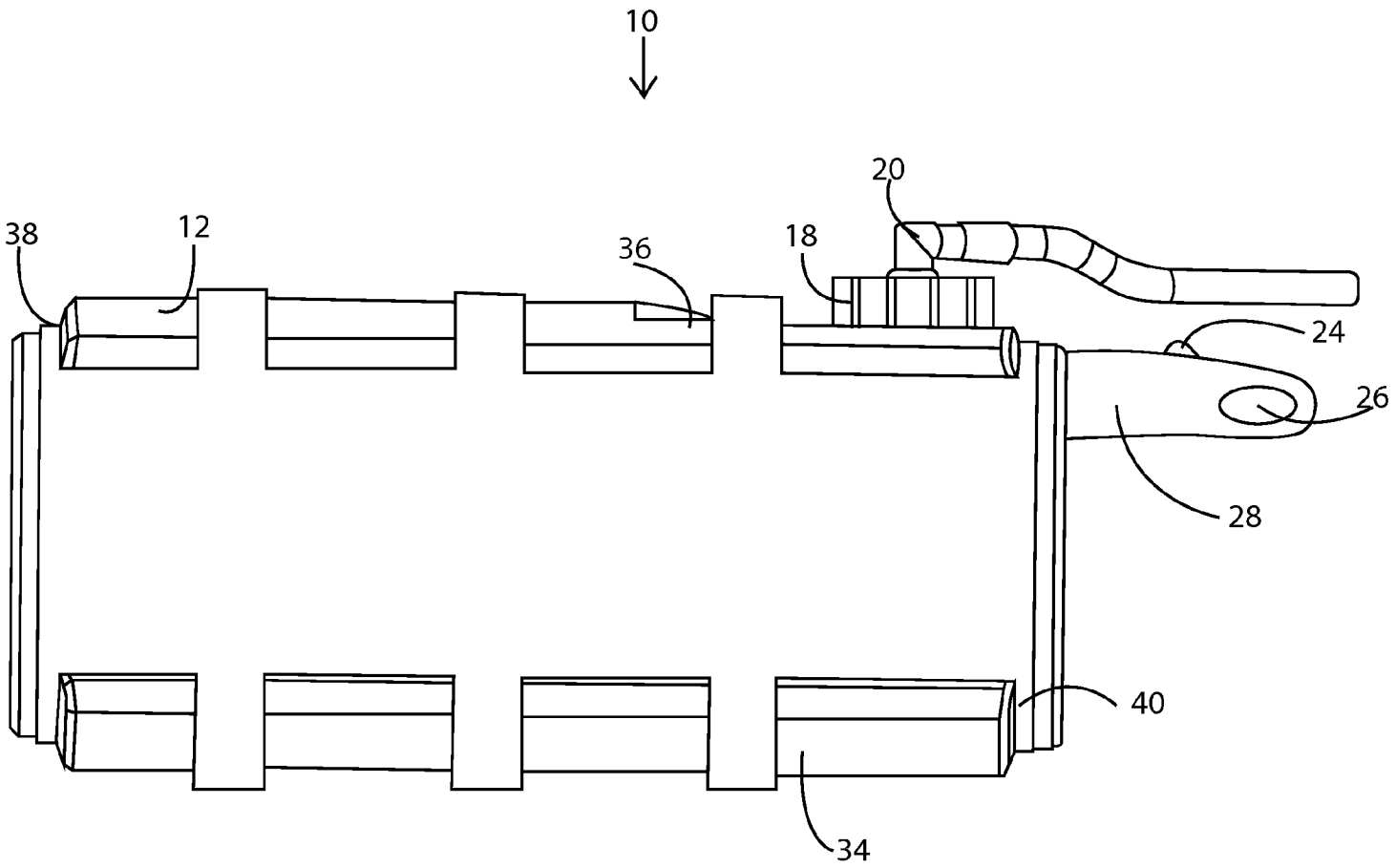
FIG. 3 is a longitudinal cross section view of the hydration system of FIG. 1 in accordance with one embodiment of the invention.

FIG. 3 is a longitudinal cross section view of the hydration system of FIG. 1 in accordance with one embodiment of the invention. This view illustrates that the tube 36 terminates at the elbow end 38 of the bladder 12 instead of the hand end 40 of the bladder 12. When the hydration system is worn by the user, the elbow end 38 is generally adjacent to the user's elbow and the hand end 40 is generally adjacent to the user's hand. When a user moves their hand to their mouth in order to drink, the liquid naturally falls to the elbow end 38 of the bladder 12. This allows the maximum amount of liquid to be extracted from the bladder 12. The bladder 14 may be made of separate compartments which are joined together so that liquid from any compartment may reach the tube 36 for withdrawal by the user.

Figure 4:
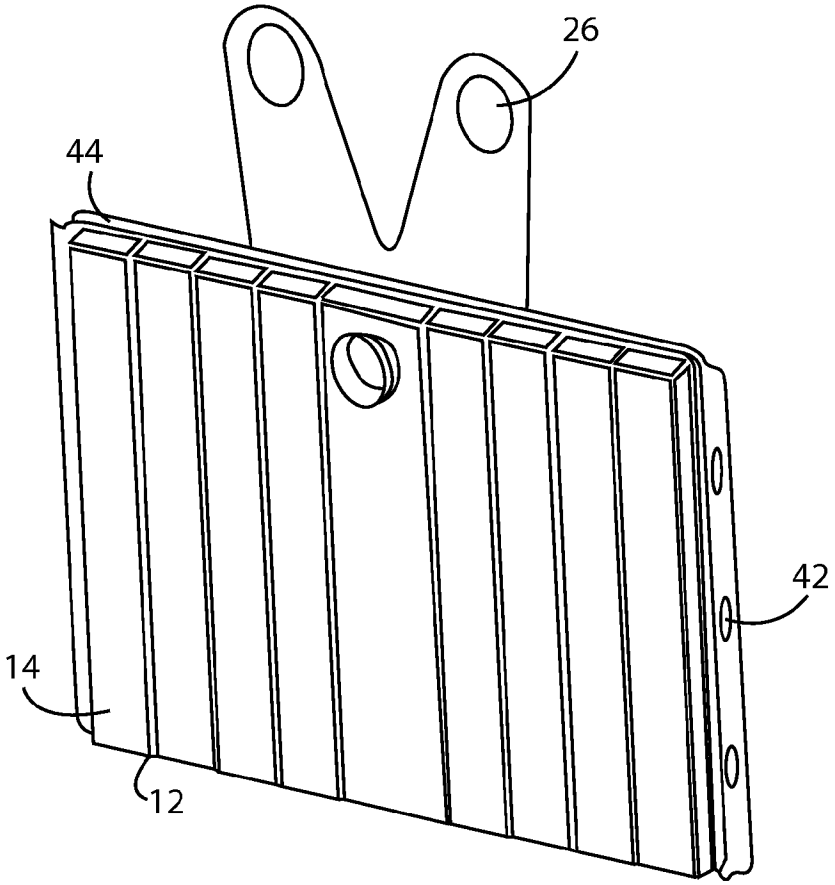
FIG. 4 is a top left perspective of a bladder of a hydration system in accordance with one embodiment of the invention.

FIG. 4 is a top left perspective of one embodiment of a bladder 12 of a hydration system in accordance with one embodiment of the invention. This figure shows the bladder laid out flat, with strap loops 42 that hold the straps 16. The bladder 12 is heat sealed along the edges 44.

Figure 5:
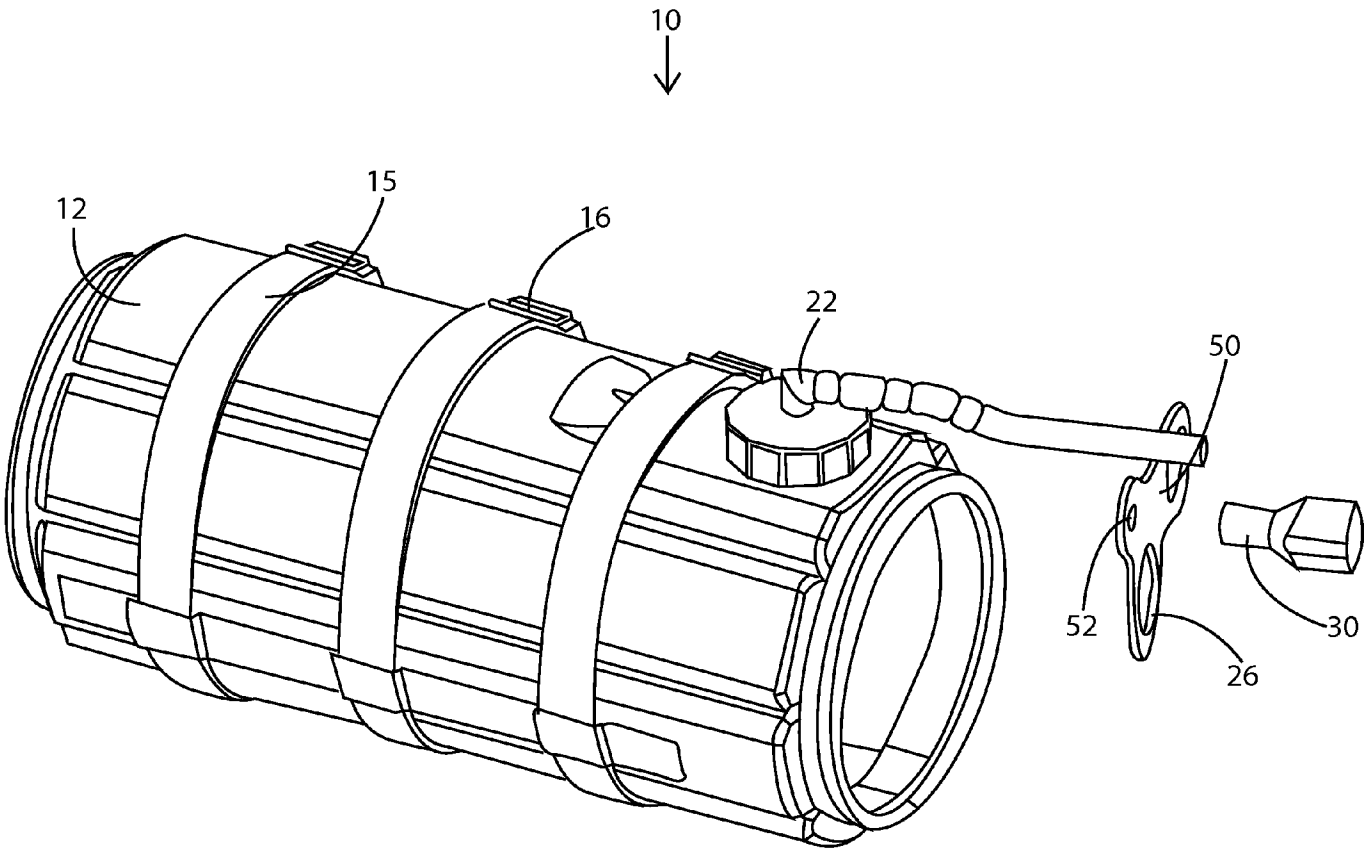
FIG. 5 is a top left perspective view of a hydration system in accordance with one embodiment of the invention.

FIG. 5 is a top left perspective view of a hydration system 10 in accordance with one embodiment of the invention. This view shows an alternative embodiment where the thumb loops 26 are in a separate thumb loop straw holder 50. The thumb loop straw holder 50 has a hole 52 for the drinking straw 22. The thumb loop straw holder 50 is attached to the straw by sliding the straw 22 through the hole 52. The bite valve 30 is then placed over the tip 54 of the straw 22.

Figure 6:
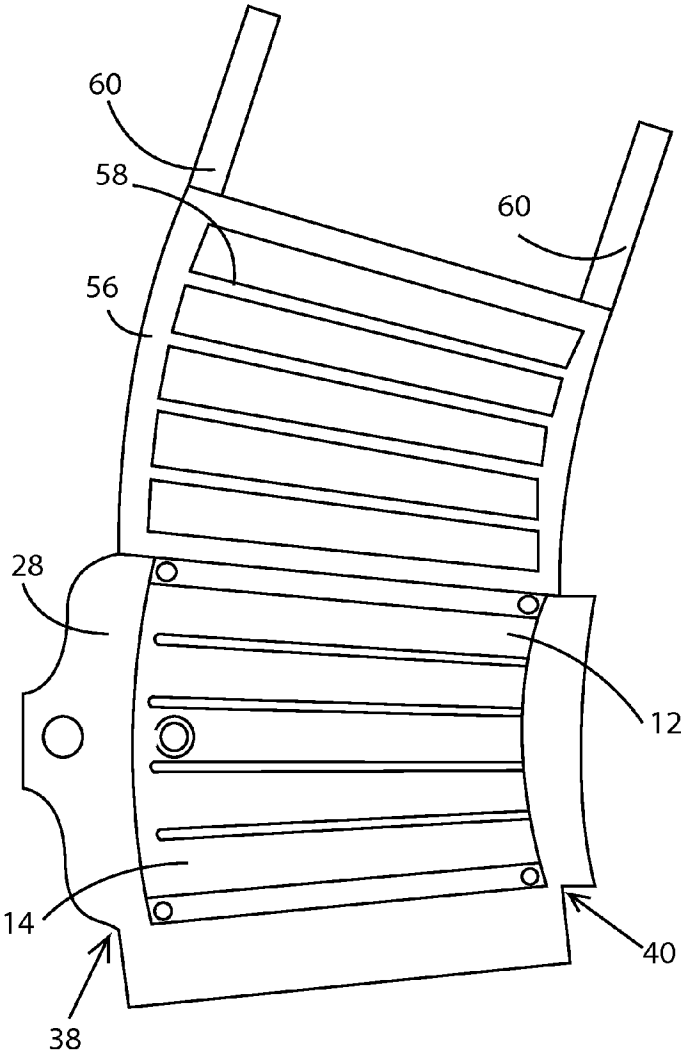
FIG. 6. is a top view of an embodiment of the hydration sleeve, with the frame in an open position.

FIG. 6 shows an alternative version of the invention, in which the hydration system 10 forms a tapering or frustoconical sleeve which fits on a users arm. This version provides a better fit for the user because most people's forearms are tapering, and thinner in diameter at the wrist than close to the elbow. In the version of the hydration sleeve shown in FIG. 6, the flexible sleeve 28 has attached to it a positioning frame 56 which has ribs 58 which fit between the expandable ribs 14 of the hydration sleeve 10. The frame 56 fits over the bladder 12 and secures to the flexible sleeve 28 by Velcro strips 60. The bladder is also secured in this embodiment by connecting pins, and other conventional forms of attachment are also possible. Shown in FIG. 1 is a valve 60 which is positioned at the elbow and 38 of the hydration system 10. Whether the drinking straw penetrates the bladder 12 at the elbow and 38 or the hand end 40, the drinking straw 22 would pick up water from a position at the elbow and 38 of the hydration system 10.

Figure 7:
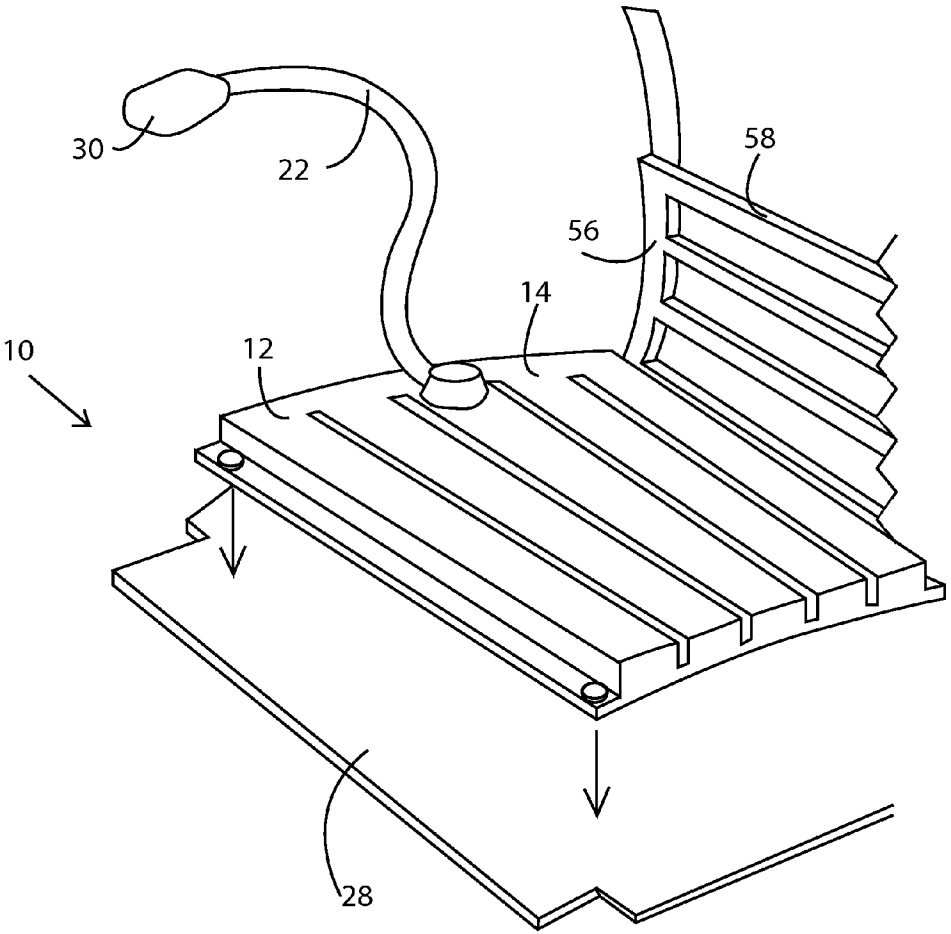
FIG. 7. is a perspective view of an embodiment of the hydration sleeve, with the frame in an open position and the bladder shown above the base.

FIG. 2 shows a view of the hydration system 10 in which the bladder 12 is positioned above the flexible sleeve 28, but is not attached to it. The frame 56 is shown in an open position with ribs 58 and ready for securing the bladder 12 by sitting between the adjustable ribs 14. Shown in FIG. 7 is a drinking straw 22 with a bite valve 30.

Figure 8:
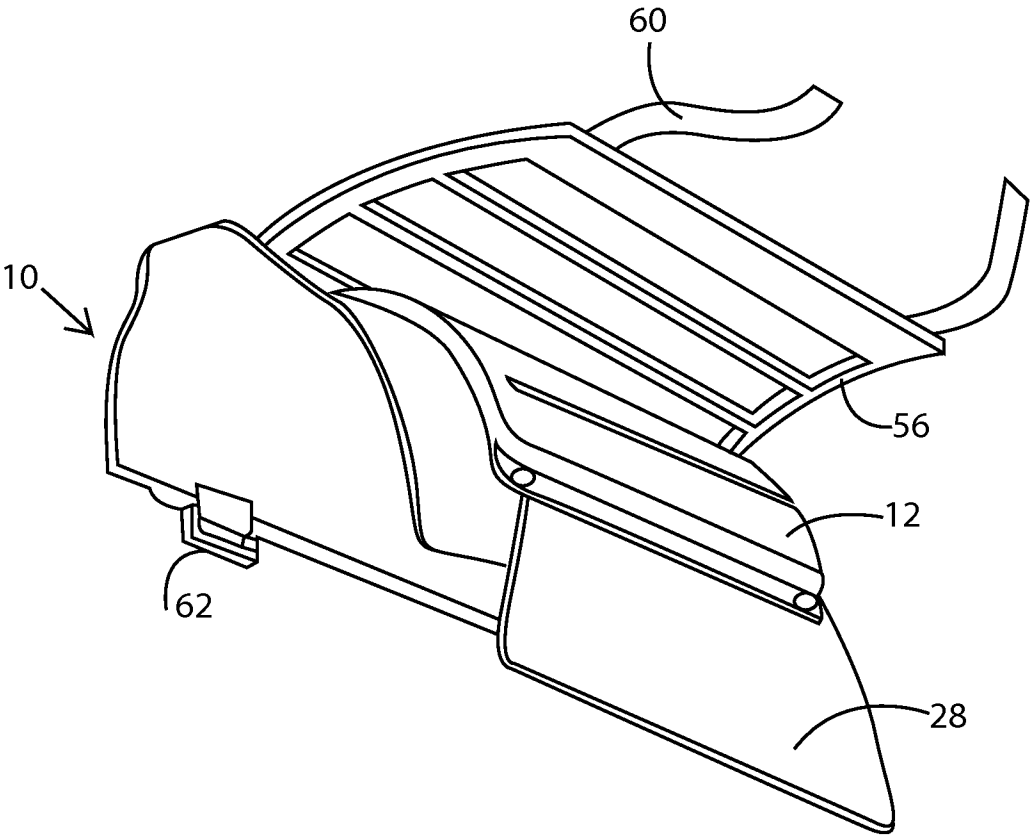
FIG. 8. is a perspective view of an embodiment of the hydration sleeve, with the frame in an open position and the bladder shown above the base.

FIG. 8 shows a perspective view of the hydration system 10 with the frame 56 and Velcro straps 60. The bladder 12 is ready to be attached to the flexible sleeve 28, at which time the frame 56 would be secured over the bladder 12 and the Velcro straps 60 would extend around the users forearm and be secured by loops 62 or other similar structures.

Figure 9:
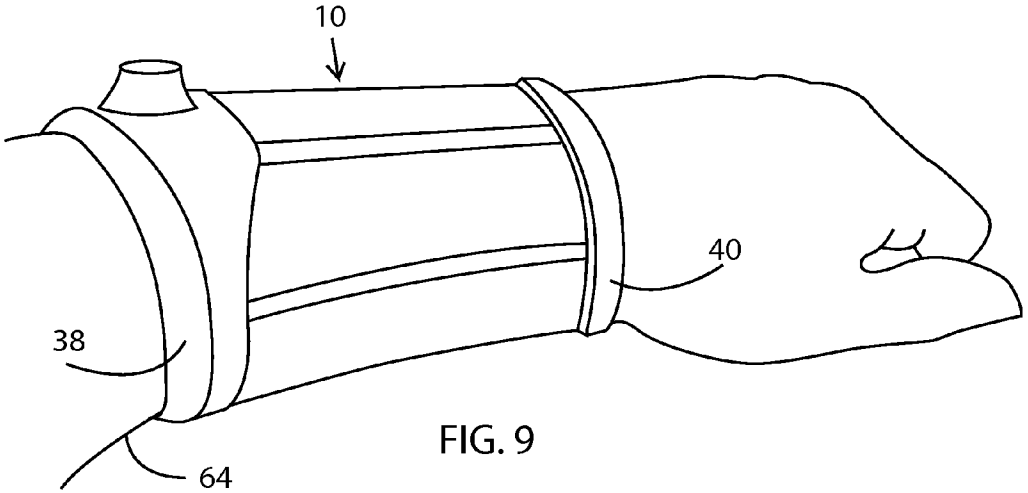
FIG. 9. is a perspective view of an embodiment of the hydration sleeve, with the sleeve mounted on a user's arm.
Figure 10:
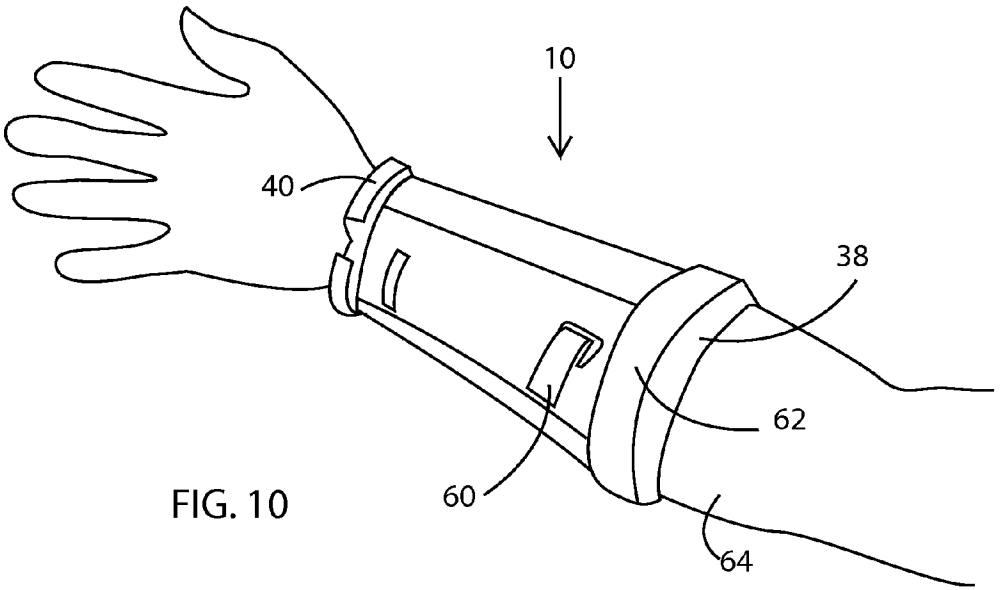
FIG. 10. is a perspective view of an embodiment of the hydration sleeve, with the sleeve mounted on a user's arm.

FIG. 9 is a perspective view of the hydration system 10 of the invention strapped onto a user's forearm 64, forming a tapering cylinder. FIG. 10 shows a perspective view of the hydration system 10 mounted on a user's forearm 64, showing the Velcro straps 60 secured through loops 62. In any of the system shown, the pickup point for water within the hydration system 10 would be at the elbow and 38 of the sleeve. The point at which the user draws in water would be at the hand end. This allows the user to perform a very natural motion of bringing his hand towards his mouth and sucking water out of a straw. When the users hand is at his mouth, it is very comfortable to have the elbow end of the hydration sleeve at a lower point than the hand. Being at a lower point than the hand allows the water in the hydration sleeve to flow by gravity to the elbow end of the hydration sleeve, for pickup by the straw or an internal tube.

The drinking straw 22 will thus run from the hand end of the sleeve to the elbow end of the sleeve. It can be internal to the sleeve or external to the sleeve. Thus the point at which the straw penetrates the sleeve can be at the hand end or at the elbow end of the sleeve. The flexible sleeve 28 can have a liner layer which can be separated or integral with the flexible sleeve. The liner layer provides a cushioning and insulating layer for the hydration sleeve, which helps in keeping the water inside the hydration sleeve from being heated by contact with the users form. The liner layer could be in two layers, one for cushioning and softness against the user's skin, and a separate layer providing insulative value between the user and the water. An insulating layer can also be provided on the side of the hydration sleeve which faces away from the user. This would aid in keeping the water at a cooler temperature than would be possible otherwise.

The frame 56 can have straps or panels which are resilient in nature in which stretch over the expandable ribs 14 of the bladder 12. These would provide some resilient force to the expandable ribs, and serve to take up any slack as the water leaves the system and the volume of the bladder becomes smaller. These would also serve to assist in helping the user withdraw water from the bladder. An optional form of the device secures the hydration system 10 to the user using an integral loop which attaches to the user above the users elbow.

Thus there has been described a hydration system that is easy to use and comfortable. This hydration system has flexible bladder that draws a vacuum while drinking through a straw, which mitigates the user's air intake. The draw tube terminates at the elbow of the bladder which allows for the maximum extraction of fluid. The draw-down straps reduce the sloshing of liquid while exercising. The end of the straw is between the thumb and forefinger, which minimizes extraneous motion when drinking. The wrap around bladder cushions the arm in case of a fall. The hydration system just slides over the user's arm, with the user's thumb sliding into the thumb loop and forefinger into the forefinger loop, and the user is ready to exercise.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A hydration system carried on an athlete's arm while exercising, comprising:

a flexible sleeve made of a flexible material and formable into a conical structure;

a bladder, made of a pliable material, having a plurality of expandable ribs, the bladder having a generally tapering cylindrical shape;

a frame attached to said flexible sleeve, with windows defined in said frame and with ribs between said windows, said ribs spaced to contact bands between said expandable ribs of said bladder when said frame is secured to said flexible sheet;

a cap detachably connected to an opening of said bladder, for adding water to said bladder;

a water extraction point in an elbow end of said bladder, for extracting water from said elbow end of said bladder, with said water extraction point in communication with said expandable ribs so that water from each of the expanding ribs can flow to said water extraction point; and a drinking straw extending from a hand end of said bladder to said water extraction point, so that a user can raise his hand with said hydration system attached, and draw water from said drinking straw at the hand end of said bladder, with the water being taken from the water extraction point at the elbow end of said bladder.

2. The hydration system of claim 1 in which said frame further comprises one of more securing straps for securing said frame to said flexible sleeve.

3. The hydration system of claim 1 which further comprises a plurality of adjustable straps attached to said bladder, the plurality of adjustable straps extending around the bladder and being perpendicular to a longitudinal axis of the bladder, said straps for securing said bladder to said flexible sleeve.

4. The hydration system of claim 1 in which said drinking straw is attached to said cap.

5. The hydration system of claim 1 in which said cap is adjacent the elbow end of said bladder.

6. The hydration system of claim 1 in which cap is adjacent the hand end of said bladder.

7. The hydration system of claim 1 which further comprises a loop attached to said elbow end for attaching said system to a user's elbow.

8. The hydration system of claim 1, which further comprises a thumb strap attached to said hand end, for engagement with a user's thumb.

9. The hydration system of claim 1, which further comprises a bite valve at an end of said drinking straw.

10. A hydration system carried on an athlete's arm while exercising, comprising:

a flexible sleeve made of a flexible material and formable into a conical structure;

a bladder, made of a pliable material, having a plurality of expandable ribs, the bladder having a generally tapering cylindrical interior shape;

an attachment means for securing said bladder to said flexible sleeve;

a cap detachably connected to an opening of said bladder, for adding water to said bladder;

a water extraction point in an elbow end of said bladder, for extracting water from said elbow end of said bladder, with said water extraction point in communication with said expandable ribs so that water from each of the expanding ribs can flow to said water extraction point; and a drinking straw extending from a hand end of said bladder to said water extraction point in the elbow end of said bladder, with an end of said straw presenting a drinking point near said hand end of said bladder, so that a user can raise his hand with said hydration system attached, and draw water from said drinking straw at the hand end of said bladder, with the water being taken from the water extraction point at the elbow end of said bladder; said attachment means is a frame attached to said flexible sleeve, with windows defined in said frame and with ribs between said windows, said ribs spaced to contact bands between said expandable ribs of said bladder when said frame is secured to said flexible sheet.

11. The hydration system of claim 10 in which said frame further comprises one of more securing straps for securing said frame to said flexible sleeve.

12. The hydration system of claim 10 which further comprises a plurality of adjustable straps attached to said bladder, the plurality of plastic straps extending around the bladder and being perpendicular to a longitudinal axis of the bladder, said straps for securing said bladder to said flexible sleeve.

13. The hydration system of claim 10 in which said drinking straw is attached to said cap.

14. The hydration system of claim 10 in which said cap is adjacent the elbow end of said bladder.

15. The hydration system of claim 10 in which cap is adjacent the hand end of said bladder.

16. The hydration system of claim 10 which further comprises a loop attached to said elbow end for attaching said system to a user's elbow.

17. The hydration system of claim 10, which further comprises a thumb strap attached to said hand end, for engagement with a user's thumb.

18. The hydration system of claim 10, which further comprises a bite valve at an end of said drinking straw.

19. A hydration system carried on an athlete's arm while exercising, comprising:

a flexible sleeve generally flat and trapezoidal in shape which is configured to form a generally conical structure when side edges of said flexible sleeve are joined together;

a generally flat and trapezoidal shaped bladder, made of a pliable material, having a plurality of expandable ribs, the bladder configured to form a generally tapering cylindrical interior shape when said bladder is attached to said flexible sleeve;

an attachment means for securing said bladder to said flexible sleeve, said attachment means being a frame attached to said flexible sleeve, with windows defined in said frame and with ribs between said windows, said ribs spaced to contact bands between said expandable ribs of said bladder when said frame is secured to said flexible sheet;

a cap detachably connected to an opening of said bladder, for adding water to said bladder;

a water extraction point in an elbow end of said bladder, for extracting water from said elbow end of said bladder, with said water extraction point in communication with said expandable ribs so that water from each of the expanding ribs can flow to said water extraction point; and a drinking straw extending from a hand end of said bladder to said water extraction point in the elbow end of said bladder, with an end of said straw presenting a drinking point near said hand end of said bladder, so that a user can raise his hand with said hydration system attached, and draw water from said drinking straw at the hand end of said bladder, with the water being taken from the water extraction point at the elbow end of said bladder.

* * * * *